US009601066B2

(12) United States Patent
Cho et al.

(10) Patent No.: US 9,601,066 B2
(45) Date of Patent: Mar. 21, 2017

(54) FIELD SEQUENTIAL DISPLAY INCLUDING PRIMARY COLOR SUB-PIXELS, A TRANSPARENT SUB-PIXEL, AND DIFFERENTLY-COLORED LIGHT SOURCES

(71) Applicant: Samsung Display Co., LTD., Yongin, Gyeonggi-Do (KR)

(72) Inventors: Jae-Hyun Cho, Seoul (KR); Sung-Jin Hong, Hwaseong-si (KR); Jae-Woong Kang, Jeonju-si (KR); Jae-Byung Park, Seoul (KR); Hyun-Min Cho, Seoul (KR)

(73) Assignee: Samsung Display Co., Ltd. (KR)

( * ) Notice: Subject to any disclaimer, the term of this patent is extended or adjusted under 35 U.S.C. 154(b) by 270 days.

(21) Appl. No.: 14/451,292

(22) Filed: Aug. 4, 2014

(65) Prior Publication Data

US 2015/0194106 A1 Jul. 9, 2015

(30) Foreign Application Priority Data

Jan. 9, 2014 (KR) ..... 10-2014-0002896

(51) Int. Cl.
*G09G 3/34* (2006.01)
*G09G 3/36* (2006.01)

(52) U.S. Cl.
CPC ..... *G09G 3/3607* (2013.01); *G09G 3/342* (2013.01); *G09G 3/3406* (2013.01); *G09G 3/3413* (2013.01); *G09G 2310/027* (2013.01); *G09G 2310/0235* (2013.01); *G09G 2310/0237* (2013.01); *G09G 2320/0242* (2013.01); *G09G 2320/0252* (2013.01); *G09G 2320/0653* (2013.01)

(58) Field of Classification Search
CPC ..... G09G 3/3413; G09G 2310/0235; G09G 2320/0242; G02F 1/133621; G02F 2001/133613; G02F 2001/133622
See application file for complete search history.

(56) References Cited

U.S. PATENT DOCUMENTS 6,961,043 B2 11/2005 Saishu et al.
7,050,031 B2 5/2006 Saishu et al.
7,119,780 B2 10/2006 Saishu et al.
(Continued)

FOREIGN PATENT DOCUMENTS

KR 10-2007-0071485 A2 7/2007
KR 10-2009-0068733 A 6/2009

*Primary Examiner* — Gene W Lee
(74) *Attorney, Agent, or Firm* — Innovations Counsel LLP

(57) ABSTRACT

A display apparatus includes a display panel, a light source part, a panel driver, and a light source driver. The display panel includes a first sub pixel having a first primary color, a second sub pixel having a second primary color, and a transparent sub-pixel. The light source part is configured to provide light to the display panel, where the light source part includes a first light source and a second light source having colors different from each other. The panel driver is configured to output to the display panel a first grayscale data, a second grayscale data, and a third grayscale data, respectively during a first sub frame, a second sub frame, and a third sub frame. The first grayscale data is associated with the first light source, and the second grayscale data and the third grayscale data are associated with the second light source.

20 Claims, 7 Drawing Sheets

(56) References Cited

U.S. PATENT DOCUMENTS

| | | | | |
|---|---|---|---|---|
| 7,358,943 | B2 * | 4/2008 | Asao | G02F 1/133555 345/690 |
| 9,280,938 | B2 * | 3/2016 | Fleck | G09G 3/3413 |
| 2005/0057473 | A1 * | 3/2005 | Hsu | G09G 3/3611 345/89 |
| 2007/0132675 | A1 * | 6/2007 | Asao | G02F 1/133555 345/80 |
| 2010/0141871 | A1 * | 6/2010 | Hsu | G02F 1/133514 349/68 |
| 2012/0162270 | A1 * | 6/2012 | Fleck | G09G 3/3413 345/690 |
| 2012/0169787 | A1 * | 7/2012 | Chen | G09G 3/3614 345/690 |
| 2013/0321495 | A1 * | 12/2013 | Yoshizawa | G02F 1/133621 345/691 |

* cited by examiner

FIELD SEQUENTIAL DISPLAY INCLUDING PRIMARY COLOR SUB-PIXELS, A TRANSPARENT SUB-PIXEL, AND DIFFERENTLY-COLORED LIGHT SOURCES

This application claims priority to Korean Patent Application No. 10-2014-0002896 filed Jan. 9, 2014 and all the benefits accruing therefrom under 35 U.S.C. §119, the content of which is herein incorporated by reference in its entirety.

BACKGROUND

1. Technical Field

The present disclosure relates to a display apparatus and a method for driving the display apparatus. More particularly, the present disclosure relates to a display apparatus with improved display quality and a method for driving the display apparatus.

2. Description of the Related Art

Generally, a liquid crystal display ("LCD") apparatus displays a multi-color image or full-color image in a spatial color display mode. In the spatial color display mode, white light emitted by a back-light unit passes through three color-filters which are spatially divided to generate a color light.

In the spatial color display mode, a unit pixel includes three color sub-pixels having the three color-filters. Accordingly, a resolution of the LCD apparatus in the spatial color display mode is substantially reduced to about ⅓ of the total number of sub-pixels. In the spatial color display mode, optical loss may occur due to absorption or reflection by the color-filters.

The back-light unit includes a light source part which provides light to a display panel. The light source part includes a red light-emitting part emitting a red light, a green light-emitting part emitting a green light, and a blue light-emitting part emitting a blue light, that are sequentially turned on when the LCD apparatus is driven using a field sequential driving method.

The field sequential driving method requires colors to be changed rapidly. However, the field sequential driving method may have a defect known as a color breakup. The color breakup may occur at an edge of an object when a speed of color switching is relatively slow.

A dichromatic field sequential driving method can be used to reduce defects in the spatial color display mode and the field sequential driving method. The dichromatic field sequential driving method uses two colors (such as a yellow color and a blue color) which are complementary related. The dichromatic field sequential driving method may be driven twice as fast (compared to the field sequential driving method) to switch between the two colors. One of the two colors may have a relatively greater effect on improving brightness, while the other of the two colors may have a relatively greater effect on a color reproducibility rate.

SUMMARY

The present disclosure is directed towards improving the display quality of a display apparatus, by addressing at least the above defects relating to color breakup.

According to an exemplary embodiment of the inventive concept, a display apparatus is provided. The display apparatus includes a display panel, a light source part, a panel driver, and a light source driver. The display panel includes a first sub pixel having a first primary color, a second sub pixel having a second primary color, and a transparent sub-pixel. The light source part is configured to provide light to the display panel, wherein the light source part includes a first light source and a second light source having colors different from each other. The panel driver is configured to output a first grayscale data to the display panel during a first sub frame, a second grayscale data to the display panel during a second sub frame, and a third grayscale data to the display panel during a third sub frame, wherein the first grayscale data is associated with the first light source, and the second grayscale data and the third grayscale data are associated with the second light source, wherein the first sub frame, the second sub frame, and the third sub frame are included in a first frame. The light source driver is configured to alternately turn on the first light source and the second light source.

In an exemplary embodiment, the light source driver may be configured to turn on the first light source during the first sub frame, and to turn on the second light source during the third sub frame.

In an exemplary embodiment, the second grayscale data may be the same as the third grayscale data, and the light source driver may be configured to turn on the first light source in an end portion of the first sub frame, and to turn on the second light source in an end portion of the third sub frame.

In an exemplary embodiment, the second grayscale data may be different from the third grayscale data, and a first interval may be the same as a second interval, the first interval corresponding to a period starting from turning on the first light source to subsequently turning on the second light source, and the second interval corresponding to a period starting from turning on the second light source to subsequently turning on the first light source.

In an exemplary embodiment, the light source driver may be configured to turn on the first light source in an end portion of the first sub frame, and to turn on the second light source in a middle portion of the third sub frame.

In an exemplary embodiment, when the third grayscale data is greater than the first grayscale data, the second grayscale data may be greater than the third grayscale data.

In an exemplary embodiment, when the third grayscale data is less than the first grayscale data, the second grayscale data may be less than the third grayscale data.

In an exemplary embodiment, the first frame may further include a fourth sub frame. A second frame may include a fifth sub frame, a sixth sub frame, a seventh sub frame, a eighth sub frame, and a ninth sub frame. The panel driver may be configured to output a fourth grayscale data to the display panel during the fourth sub frame, a fifth grayscale data to the display panel during the fifth sub frame, a sixth grayscale data to the display panel during the fifth sub frame, a seventh grayscale data to the display panel during the seventh sub frame, a eighth grayscale data to the display panel during the eighth sub frame, and a ninth grayscale data to the display panel during the ninth sub frame. The fourth grayscale data and the seventh grayscale data may be associated with the first light source. The fifth grayscale data, the sixth grayscale data, the eighth grayscale data, and the ninth grayscale data may be associated with the second light source.

In an exemplary embodiment, the light source driver may be configured to turn on the first light source during the first sub frame, the fourth sub frame, and the seventh sub frame, and to turn on the second light source during the third sub frame, the sixth sub frame, and the ninth sub frame.

In an exemplary embodiment, a first interval may be the same as a second interval, the first interval corresponding to a period starting from turning on the first light source to subsequently turning on the second light source, and the second interval corresponding to a period starting from turning on the second light source to subsequently turning on the first light source.

In an exemplary embodiment, the light source driver may be configured to turn on the first light source in end portions of the first sub frame, the fourth sub frame, and the seventh sub frame, and to turn on the second light source in middle portions of the third sub frame, the sixth sub frame, and the ninth sub frame.

In an exemplary embodiment, when the third grayscale data is greater than the first grayscale data, the second grayscale data may be greater than the third grayscale data. When the sixth grayscale data is greater than the fourth grayscale data, the fifth grayscale data may be greater than the sixth grayscale data. When the ninth grayscale data is greater than the seventh grayscale data, the eighth grayscale data may be greater than the ninth grayscale data.

In an exemplary embodiment, the second grayscale data, the third grayscale data, the fifth grayscale data, the sixth grayscale data, the eighth grayscale data, and the ninth grayscale data may include grayscale values corresponding to a black image.

In an exemplary embodiment, the first light source may be configured to generate light having one of the third primary color and a mixed color of the first primary color and the second primary color, and the second light source may be configured to generate light having the other one of the third primary color and the mixed color of the first primary color and the second primary color.

In an exemplary embodiment, the mixed color may be yellow, and the third primary color may be blue.

According to another exemplary embodiment of the inventive concept, a method of driving a display apparatus is provided. The method includes outputting a first grayscale data to a display panel during a first sub frame, the first grayscale data associated with a first light source, wherein the display panel includes a first sub pixel having a first primary color, a second sub pixel having a second primary color, and a transparent sub pixel. The method further includes turning on the first light source during the first sub frame, outputting a second grayscale data to the display panel during a second sub frame, the second grayscale data associated with a second light source having different color from the first light source, outputting a third grayscale data to the display panel during a third sub frame, the third grayscale data associated with the second light source, and turning on the second light source during the third sub frame, where the first sub frame, the second sub frame, and the third sub frame are included in a first frame.

In an exemplary embodiment, the first light source may be configured to be turned on in an end portion of the first sub frame, the second light source may be configured to be turned on in an end portion of the third sub frame, and the second grayscale data may be the same as the third grayscale data.

In an exemplary embodiment, a first interval may be the same as a second interval, the first interval corresponding to a period starting from turning on the first light source to subsequently turning on the second light source, and the second interval corresponding to a period starting from turning on the second light source to subsequently turning on the first light source. When the third grayscale data is greater than the first grayscale data, the second grayscale data may be greater than the third grayscale data, and when the third grayscale data is less than the first grayscale data, the second grayscale data may be less than the third grayscale data.

In an exemplary embodiment, the method of driving the display apparatus may further include: outputting a fourth grayscale data to the display panel during a fourth sub frame, the fourth grayscale data associated with the first light source; turning on the first light source during the fourth sub frame; outputting a fifth grayscale data to the display panel during a fifth sub frame, the fifth grayscale data associated with the second light source; outputting a sixth grayscale data to the display panel during a sixth sub frame, the sixth grayscale data associated with the second light source; turning on the second light source during the sixth sub frame; outputting a seventh grayscale data to the display panel during a seventh sub frame, the seventh grayscale data associated with the first light source; turning on the first light source during the seventh sub frame; outputting an eighth grayscale data to the display panel during a eighth sub frame, the eighth grayscale data associated with the second light source; outputting a ninth grayscale data to the display panel during a ninth sub frame, the ninth grayscale data associated with the second light source; and turning on the second light source during the ninth sub frame, where the first frame may further include the fourth sub frame, and a second frame may include the fifth sub frame, the sixth sub frame, the seventh sub frame, the eighth sub frame, and the ninth sub frame.

In an exemplary embodiment, a first interval may be the same as a second interval, the first interval corresponding to a period starting from turning on the first light source to subsequently turning on the second light source, and the second interval corresponding to a period starting from turning on the second light source to subsequently turning on the first light source.

According to one or more of the above exemplary embodiments of the display apparatus and the method for driving the display apparatus, the display apparatus may control the number of grayscale data associated with the light sources when driven in the dichromatic field sequential driving method. Thus, a display quality of the display apparatus may be improved using one or more of the above exemplary embodiments.

BRIEF DESCRIPTION OF THE DRAWINGS

The above and other features and advantages of the inventive concept will be more apparent when exemplary embodiments thereof are described in detail with reference to the accompanying drawings.

DETAILED DESCRIPTION

Hereinafter, the inventive concept will be explained in detail with reference to the accompanying drawings.

Figure 1:
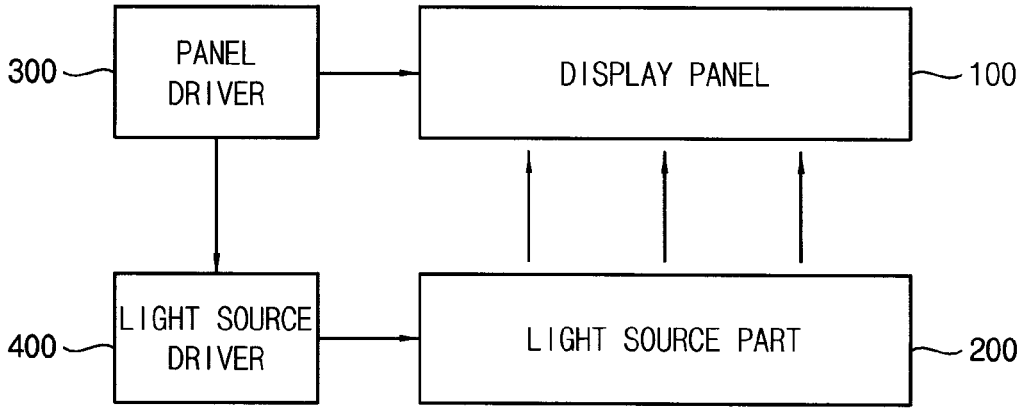
FIG. 1 is a block diagram illustrating a display apparatus according to an exemplary embodiment of the inventive concept.
Figure 2:
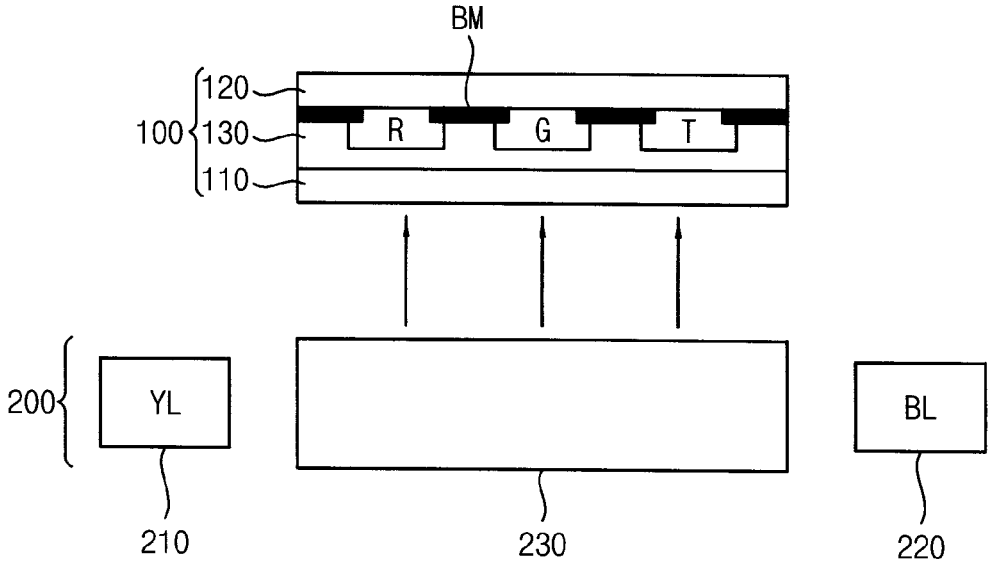
FIG. 2 is a cross-sectional view illustrating a display panel and a light source part of FIG. 1.
Figure 3A:
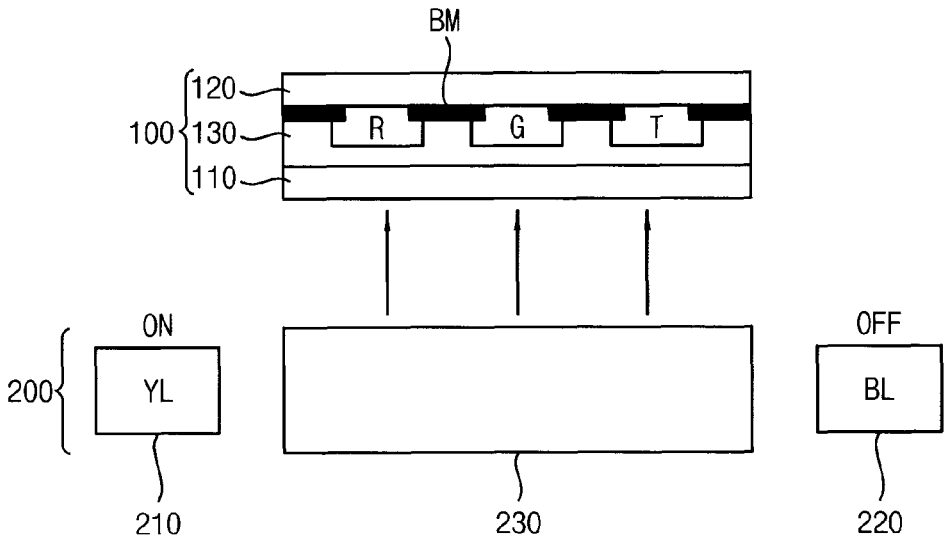
FIGS. 3A and 3B are cross-sectional views illustrating the display panel and the light source part of FIG. 1 in accordance with a method of driving the display apparatus.
Figure 3B:
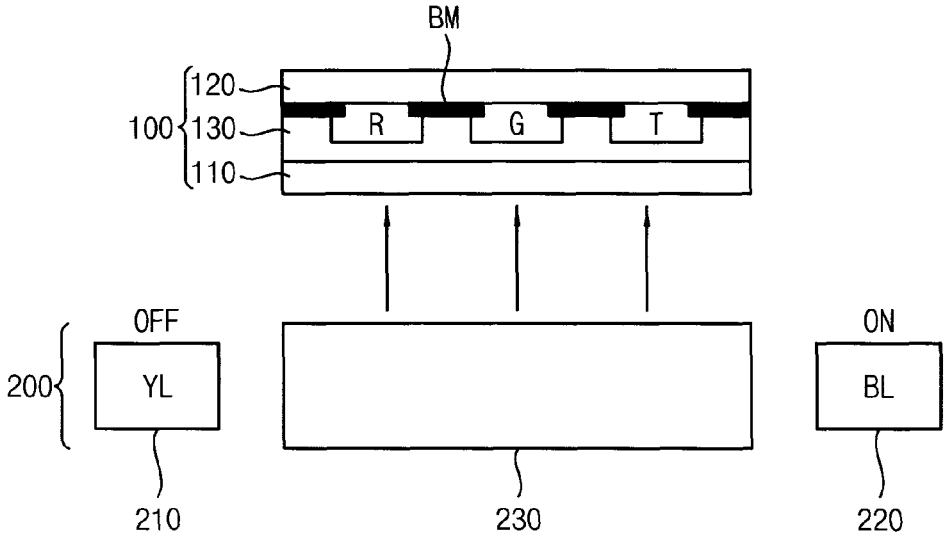

FIG. 1 is a block diagram illustrating a display apparatus according to an exemplary embodiment of the inventive concept. FIG. 2 is a cross-sectional view illustrating the display panel and the light source part of FIG. 1. FIGS. 3A and 3B are cross-sectional views illustrating the display panel and the light source part of FIG. 1 in accordance with an exemplary method of driving the display apparatus.

Referring to FIGS. 1 to 3B, the display apparatus includes a display panel 100, a light source part 200, a panel driver 300, and a light source driver 400.

The display panel 100 displays an image. The display panel 100 includes a first substrate 110, a second substrate 120, and a liquid crystal layer 130.

The display panel 100 includes a first sub pixel R having a first primary color, a second sub pixel G having a second primary color, and a transparent sub pixel T.

In an exemplary embodiment, the first primary color may be red, and the first sub pixel R may be a red sub pixel. The second primary color may be green, and the second sub pixel G may be a green sub pixel.

The first substrate 110 may be a thin film transistor ("TFT") substrate including a plurality of TFTs. The first substrate 110 may further include a plurality of gate lines extending substantially in a first direction and a plurality of data lines extending substantially in a second direction crossing the first direction. The first substrate 110 may further include a pixel electrode.

The second substrate 120 is disposed opposite to (e.g., facing) the first substrate 110. The second substrate 120 may be a color filter substrate including a plurality of color filters. The second substrate 120 may further include a common electrode.

The first sub pixel R may be defined by a red color filter disposed on the second substrate 120. The second sub pixel G may be defined by a green color filter disposed on the second substrate 120. The transparent sub pixel T may be defined by a transparent color filter disposed on the second substrate 120. For example, the transparent color filter may be defined by a substantially empty space in which no color filter is disposed. A light blocking pattern BM may be disposed between the color filters.

The liquid crystal layer 130 is disposed between the first and second substrates 110 and 120.

In an exemplary embodiment, the color filters are disposed on the second substrate 120, but the inventive concept is not limited thereto. In one alternative exemplary embodiment, for example, the color filters may be disposed on the first substrate 110, which is referred to as a color filter on array structure.

The panel driver 300 is connected to the display panel 100 and drives the display panel 100. The panel driver 300 may include a timing controller, a gate driver, and a data driver.

The timing controller generates a first control signal that controls a driving timing of the gate driver, and outputs the first control signal to the gate driver. The timing controller also generates a second control signal that controls a driving timing of the data driver, and outputs the second control signal to the data driver. The gate driver outputs a gate signal to the gate lines. The data driver outputs a data signal to the data lines.

The panel driver 300 sets grayscale data of the first sub pixel R, the second sub pixel G, and the transparent sub pixel T. The panel driver 300 outputs the grayscale data to the display panel 100.

The panel driver 300 generates a light source control signal that controls a driving timing of the light source driver 400, and outputs the light source control signal to the light source driver 400. The panel driver 300 may be substantially synchronized with the light source driver 400.

The light source part 200 includes a first light source 210 and a second light source 220, which have colors different from each other. The light source part 200 may further include a light guide plate 230. The light source part 200 generates light and provides the light to the display panel 100.

The first light source 210 generates light having a mixed color of the first primary color and the second primary color. In an exemplary embodiment, the first primary color may be red, the second primary color may be green, and the mixed color of the first and second primary colors may be yellow.

The second light source 220 generates light having a third primary color. The third primary color may be blue.

When the first, second, and third primary colors are mixed with one another, the mixed color is white. In an exemplary embodiment, the first, second, and third primary colors may be red, green, and blue, respectively, but the inventive concept is not limited thereto.

In an exemplary embodiment, the first light source 210 may be a light emitting diode ("LED") chip which emits yellow light. The second light source 220 may be a LED chip which emits blue light. In an alternative exemplary embodiment, the first light source 210 may include a blue LED chip and a yellow phosphor.

The light guide plate 230 guides the light from the first and second light sources 210 and 220 to the display panel 100.

In an exemplary embodiment, the first light source 210 may be disposed facing a first side of the light guide plate 230, and the second light source 220 may be disposed facing a second side of the light guide plate 230 opposite to the first side of the light guide plate 230.

In some alternative embodiments, the first and second light sources 210 and 220 may be disposed facing the first side.

For example, the first light source 210 and the second light source 220 may form a double layer facing the first side of the light guide plate 230. For example, the first light source 210 is disposed in a first layer facing the first side of the light guide plate 230, and the second light source 210 is disposed in a second layer (the second layer being disposed on the first layer) facing the first side of the light guide plate 230. For example, the first and second light sources 210 and 220 may be alternately disposed in the same layer. For example, the first and second light sources 210 and 220 may be alternately disposed in a first layer, and the first and second light sources 210 and 220 may be alternately disposed in a second layer that is disposed on the first layer. In such an embodiment, the second light source 220 in the second layer may be disposed on the first light source 210 in the first layer, and the first light source 210 in the second layer may be disposed on the second light source 220 in the first layer.

Alternatively, the first light source 210 and the second light source 220 may be formed in a package. The package may include a LED and a phosphor. For example, the LED in the package may have the third primary color. The phosphor in the package may have the mixed color.

For example, the package may include a side wall that divides the package into a first receiving area and a second receiving area. The first light source 210 may be defined as a first LED of the third primary color on a bottom surface of the first receiving area, with the phosphor of the mixed color filling the first receiving area. The second light source 220 may be defined as a second LED of the third primary color. The second receiving area may be filled with a transparent resin.

In an exemplary embodiment, the light source part 200 is an edge type light source part including the light guide plate 230 and the first and second light sources 210 and 220 disposed on side portions of the light guide plate 230, but the inventive concept is not limited thereto. In an alternative exemplary embodiment, the light source part 200 may be a direct type light source part including a plurality of light sources disposed under the display panel 100 and overlapping an entire area of the display panel 100.

In an exemplary embodiment, the display apparatus is the liquid crystal display apparatus including the liquid crystal layer 130, but the inventive concept is not limited thereto. In an alternative exemplary embodiment, the display apparatus may be an organic light emitting diode ("OLED") display apparatus including the OLEDs.

The light source driver 400 is connected to the light source part 200. The light source driver 400 drives the light source part 200. The light source driver 400 repeatedly turns on and off at least one of the first and second light sources 210 and 220.

In an exemplary embodiment, the light source driver 400 may alternately turn on the first and second light sources 210 and 220. For example, the first light source 210 is turned on during a first sub frame, and the second light source 220 is turned off during the first sub frame. The first light source 210 is turned off during a second sub frame, and the second light source 220 is turned on during the second sub frame.

Next, a method of outputting the grayscale data to the display panel 100 by the panel driver 300 and a method of driving the light source part 200 by the light source driver 400 are described in more detail with reference to FIGS. 4A and 4B.

Figure 4A:
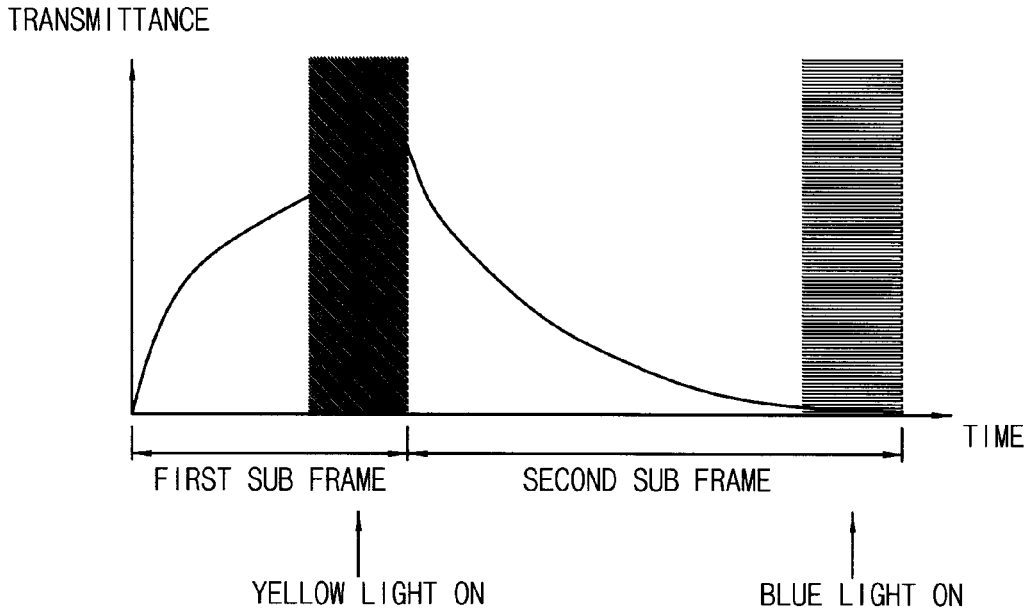
FIGS. 4A and 4B illustrate emitting timing diagrams based on a liquid crystal response in a first sub frame and a second sub frame.
Figure 4B:
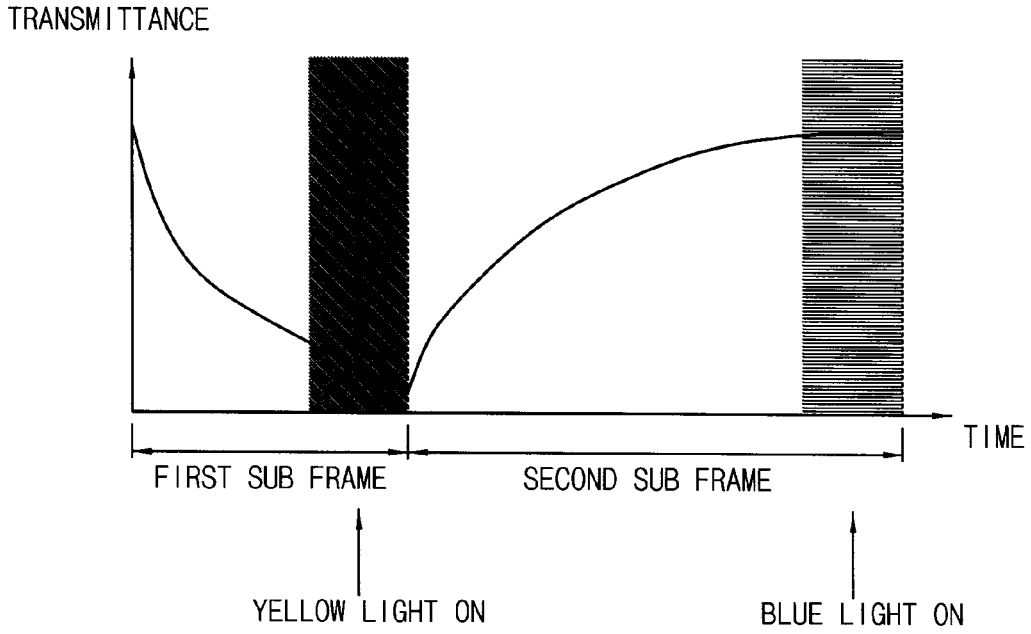

FIGS. 4A and 4B illustrate emitting timing diagrams based on a liquid crystal response in a first sub frame and a second sub frame.

Referring to FIGS. 1 to 4B, a frame (e.g., a unit frame corresponding to a single input image data) is divided into two sub frames. A first frame includes a first sub frame and a second sub frame.

The grayscale data includes a first grayscale data associated with the first light source 210 and a second grayscale data associated with the second light source 220.

The panel driver 300 outputs the first grayscale data to the display panel 100 during the first sub frame. The panel driver 300 outputs the second grayscale data to the display panel 100 during the second sub frame.

A liquid crystal molecule of the liquid crystal layer 130 is re-aligned to display a grayscale of the first grayscale data during the first sub frame. The light source driver 400 turns on the first light source 210 during the first sub frame. For example, the light source driver 400 may turn on the first light source 210 in an end portion of the first sub frame.

The liquid crystal molecule of the liquid crystal layer 130 is re-aligned to display a grayscale of the second grayscale data during the second sub frame. The light source driver 400 turns on the second light source 220 during the second sub frame. For example, the light source driver 400 may turn on the second light source 220 in an end portion of the second sub frame.

Referring to FIG. 4A, the liquid crystal molecule of the liquid crystal layer 130 is re-aligned to display a relatively high grayscale during the first sub frame. Thus, most of the light emitted from the first light source 210 may pass through the liquid crystal layer 130. The liquid crystal molecule of the liquid crystal layer 130 is re-aligned to display a relatively low grayscale during the second sub frame. Thus, most of the light emitted from the second light source 220 may not pass through the liquid crystal layer 130.

Referring to FIG. 4B, the liquid crystal molecule of the liquid crystal layer 130 is re-aligned to display a relatively low grayscale during the first sub frame. Thus, most of the light emitted from the first light source 210 may not pass through the liquid crystal layer 130. The liquid crystal molecule of the liquid crystal layer 130 is re-aligned to display a relatively high grayscale during the second sub frame. Thus, most of the light emitted from the second light source 220 may pass through the liquid crystal layer 130.

A duration of the first sub frame may be different from a duration of the second sub frame. Alternatively, a duration of the first sub frame may be substantially equal to a duration of the second sub frame.

Figure 5A:
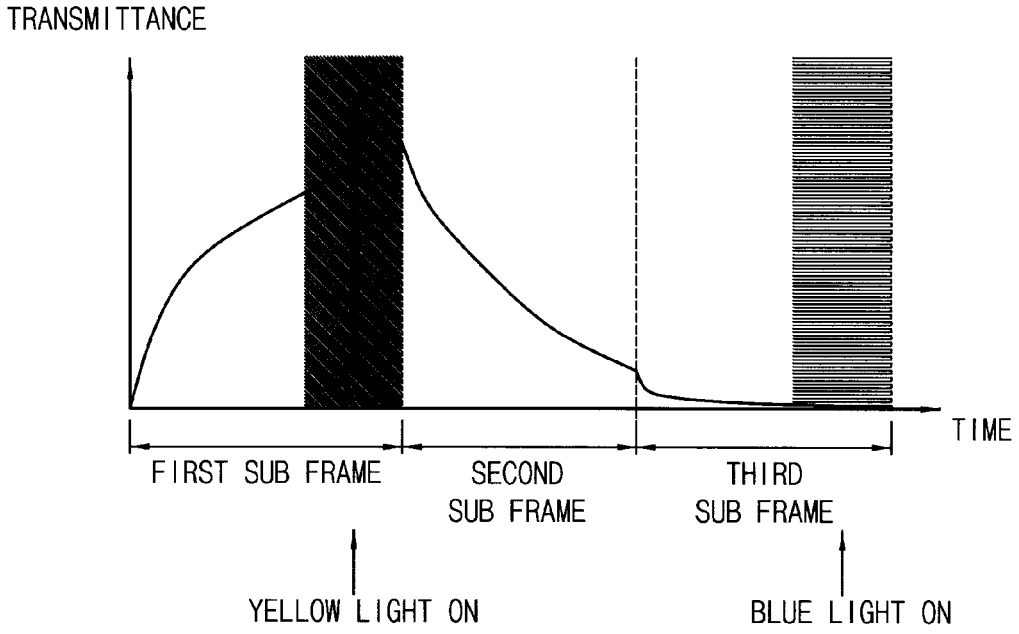
FIGS. 5A and 5B illustrate emitting timing diagrams based on a liquid crystal response in a first sub frame to a third sub frame according to an exemplary embodiment of the inventive concept.
Figure 5B:
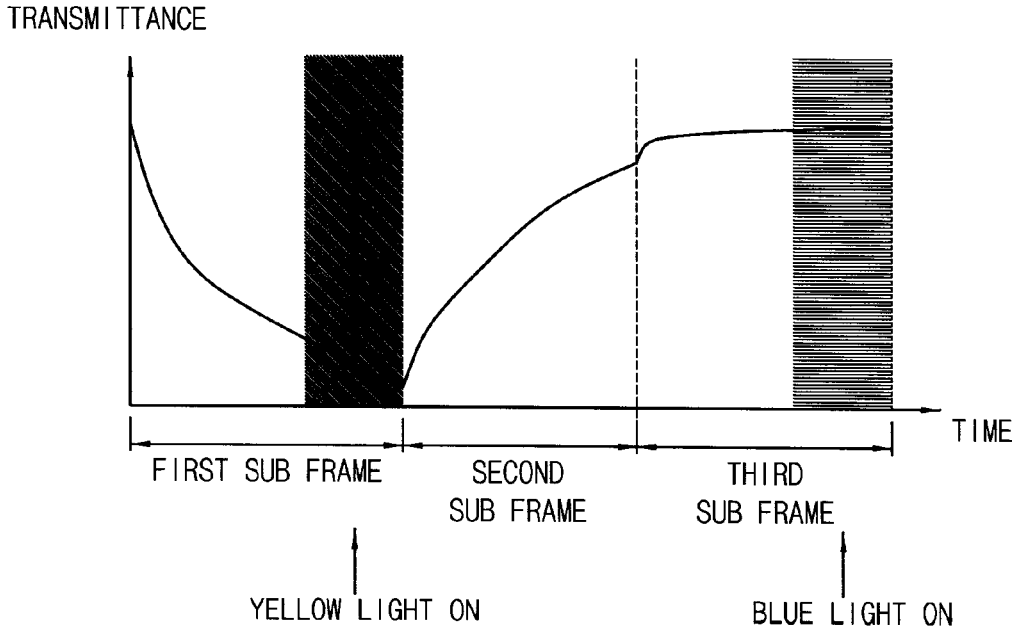

FIGS. 5A and 5B illustrate emitting timing diagrams based on a liquid crystal response in a first sub frame to a third sub frame according to an exemplary embodiment of the inventive concept.

The display apparatus according to the exemplary embodiment illustrated in FIGS. 5A and 5B is substantially the same as the display apparatus in FIGS. 1 to 4B except for the driving timing of the panel driver and the light source driver. Thus, the same reference numerals will be used to refer to same or like parts as those described with reference to FIGS. 1 to 4B and any further repetitive explanation concerning the above elements will be omitted.

Referring to FIGS. 1 to 3B, 5A, and 5B, a frame (e.g., a unit frame corresponding to a single input image data) is divided into three sub frames. A first frame includes a first sub frame, a second sub frame, and a third sub frame.

The grayscale data includes a first grayscale data associated with the first light source 210, a second grayscale data associated with the second light source 220, and a third grayscale data associated with the second light source 220.

The panel driver 300 outputs the first grayscale data to the display panel 100 during the first sub frame. The panel driver 300 outputs the second grayscale data to the display panel 100 during the second sub frame. The panel driver 300 outputs the third grayscale data to the display panel 100 during the third sub frame.

A liquid crystal molecule of the liquid crystal layer 130 is re-aligned to display a grayscale of the first grayscale data during the first sub frame. The light source driver 400 turns on the first light source 210 during the first sub frame. For example, the light source driver 400 may turn on the first light source 210 in an end portion of the first sub frame.

The liquid crystal molecule of the liquid crystal layer 130 is re-aligned to display a grayscale of the second grayscale data during the second sub frame.

The liquid crystal molecule of the liquid crystal layer 130 is re-aligned to display a grayscale of the third grayscale data during the third sub frame. The light source driver 400 turns on the second light source 220 during the third sub frame. For example, the light source driver 400 may turn on the second light source 220 in an end portion of the third sub frame.

Referring to FIG. 5A, the liquid crystal molecule of the liquid crystal layer 130 is re-aligned to display a relatively high grayscale during the first sub frame. Thus, most of the light emitted from the first light source 210 may pass through the liquid crystal layer 130.

The liquid crystal molecule of the liquid crystal layer 130 is re-aligned to display a relatively low grayscale during the second sub frame. In the second sub frame, the first and second light sources 210 and 220 may not emit the light.

During the third sub frame, the liquid crystal molecule of the liquid crystal layer 130 is re-aligned by the third grayscale data to display a grayscale which is less than the grayscale of the second sub frame. Thus, most of the light emitted from the second light source 220 may not pass through the liquid crystal layer 130.

Referring to FIG. 5B, the liquid crystal molecule of the liquid crystal layer 130 is re-aligned to display a relatively low grayscale during the first sub frame. Thus, most of the light emitted from the first light source 210 may not pass through the liquid crystal layer 130.

The liquid crystal molecule of the liquid crystal layer 130 is re-aligned to display a relatively high grayscale during the second sub frame. In the second sub frame, the first and second light sources 210 and 220 may not emit the light.

During the third sub frame, the liquid crystal molecule of the liquid crystal layer 130 is re-aligned by the third grayscale data to display a grayscale which is greater than the grayscale of the second sub frame. Thus, most of the light emitted from the second light source 220 may pass through the liquid crystal layer 130.

In the present exemplary embodiment, the second grayscale data may be substantially the same as the third grayscale data. The panel driver 300 outputs the second grayscale data to the display panel 100 during the second sub frame, and outputs the third grayscale data (which is substantially the same as the second grayscale data) to the display panel 100 during the third sub frame. Thus, a response speed of the liquid crystal layer 130 may increase.

Figure 6:
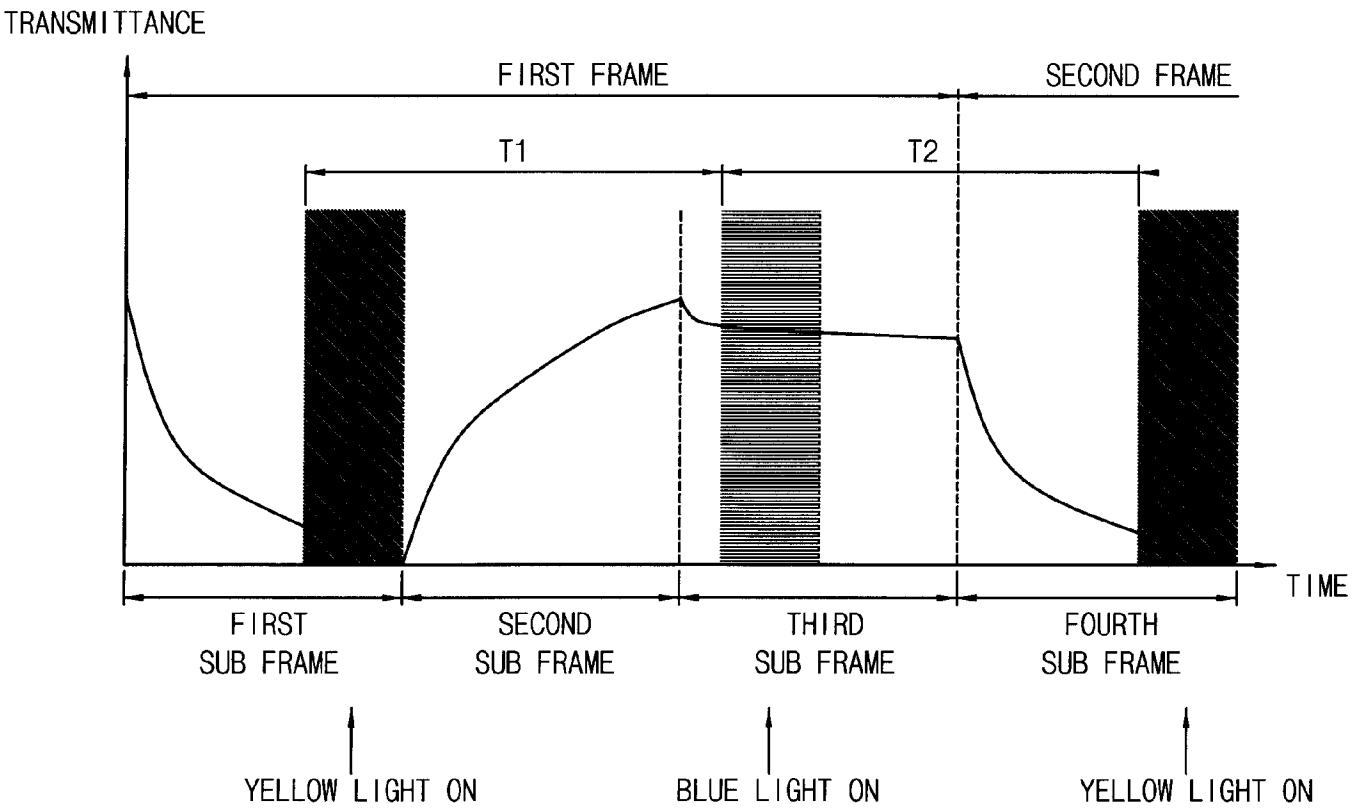
FIG. 6 illustrates an emitting timing diagram based on a liquid crystal response in a first sub frame to a third sub frame according to an exemplary embodiment of the inventive concept.

FIG. 6 illustrates an emitting timing diagram based on a liquid crystal response in a first sub frame to a third sub frame according to an exemplary embodiment of the inventive concept.

The display apparatus according to the exemplary embodiment illustrated in FIG. 6 is substantially the same as the display apparatus in FIGS. 1 to 4B except for the driving timing of the panel driver and the light source driver. Thus, the same reference numerals will be used to refer to same or like parts as those described with reference to FIGS. 1 to 4B and any further repetitive explanation concerning the above elements will be omitted.

Referring to FIGS. 1 to 3B and 6, a frame (e.g., a unit frame corresponding to a single input image data) is divided into three sub frames. A first frame includes a first sub frame, a second sub frame, and a third sub frame. A second frame includes a fourth sub frame.

The grayscale data includes a first grayscale data associated with the first light source 210, a second grayscale data associated with the second light source 220, and a third grayscale data associated with the second light source 220.

The panel driver 300 outputs the first grayscale data to the display panel 100 during the first sub frame. The panel driver 300 outputs the second grayscale data to the display panel 100 during the second sub frame. The panel driver 300 outputs the third grayscale data to the display panel 100 during the third sub frame.

A liquid crystal molecule of the liquid crystal layer 130 is re-aligned to display a grayscale of the first grayscale data during the first sub frame. The light source driver 400 turns on the first light source 210 during the first sub frame. For example, the light source driver 400 may turn on the first light source 210 in an end portion of the first sub frame.

The liquid crystal molecule of the liquid crystal layer 130 is re-aligned to display a grayscale of the second grayscale data during the second sub frame. The second grayscale data may include an over-drive value to increase a response speed of the liquid crystal layer 130 during the third sub frame.

The liquid crystal molecule of the liquid crystal layer 130 is re-aligned to display a grayscale of the third grayscale data during the third sub frame. The light source driver 400 turns on the second light source 220 during the third sub frame. A first interval T1 corresponds to a period starting from turning on the first light source 210 to subsequently turning on the second light source 220. A second interval T2 corresponds to a period starting from turning on the second light source 220 to subsequently turning on the first light source 210 in the fourth sub frame. The first interval T1 may be substantially the same as the second interval T2. For example, the light source driver 400 may turn on the second light source 220 in a middle portion of the third sub frame.

The third grayscale data is applied to pre-tilting liquid crystal molecules to increase the response speed of the liquid crystal layer 130 during the third sub frame.

Referring to FIG. 6, the liquid crystal molecule of the liquid crystal layer 130 is re-aligned to display a relatively low grayscale during the first sub frame. Thus, most of the light emitted from the first light source 210 may not pass through the liquid crystal layer 130.

The liquid crystal molecule of the liquid crystal layer 130 is re-aligned to display a relatively high grayscale during the second sub frame. The grayscale of the third grayscale data is greater than the grayscale of the first grayscale data. Thus, the grayscale of the second grayscale data may be greater than the grayscale of the third grayscale data, so as to increase the response speed of the liquid crystal layer 130 during the third sub frame. Thus, during the second sub frame, the liquid crystal molecule of the liquid crystal layer 130 is re-aligned to display a grayscale which is greater than the grayscale of the third sub frame.

In the second sub frame, the first and second light sources 210 and 220 may not emit the light.

During the third sub frame, the liquid crystal molecule of the liquid crystal layer 130 is re-aligned by the third grayscale data to display a grayscale which is less than the grayscale of the second sub frame. The second light source 220 is turned on in a middle portion of the third sub frame, and emits the light. Thus, the grayscale of the third grayscale data may be less than a grayscale corresponding to a turning on timing of the second light source 220.

Thus, a desired amount of the light emitted from the second light source 220 may pass through the liquid crystal layer 130 to display a desired grayscale.

Although not shown in the figures, the liquid crystal molecule of the liquid crystal layer 130 may be re-aligned to display a relatively high grayscale during the first sub frame. Thus, the light emitted from the first light source 210 may pass through the liquid crystal layer 130.

The liquid crystal molecule of the liquid crystal layer 130 is re-aligned to display a relatively low grayscale during the second sub frame. When the grayscale of the third grayscale data is less than the grayscale of the first grayscale data, the grayscale of the second grayscale data may be less than the grayscale of the third grayscale data, so as to increase the response speed of the liquid crystal layer 130 during the third sub frame. Thus, during the second sub frame, the liquid crystal molecule of the liquid crystal layer 130 is re-aligned to display a grayscale which is less than the grayscale of the third sub frame.

In the second sub frame, the first and second light sources 210 and 220 may not emit the light.

During the third sub frame, the liquid crystal molecule of the liquid crystal layer 130 is re-aligned by the third grayscale data to display a grayscale which is greater than the grayscale of the second sub frame. The second light source 220 is turned on in a middle portion of the third sub frame, and emits the light. Thus, the grayscale of the third grayscale data may be greater than a grayscale corresponding to a turning on timing of the second light source 220.

Thus, a desired amount of the light emitted from the second light source 220 may pass through the liquid crystal layer 130 to display a desired grayscale.

In the present exemplary embodiment, the second grayscale data including the over-drive value is output to the display panel 100 during the second sub frame. The third grayscale data (which is applied to pre-tilting liquid crystal molecules) is output to the display panel 100 during the third sub frame. Thus, a response speed of the liquid crystal layer 130 may increase.

Figure 7:
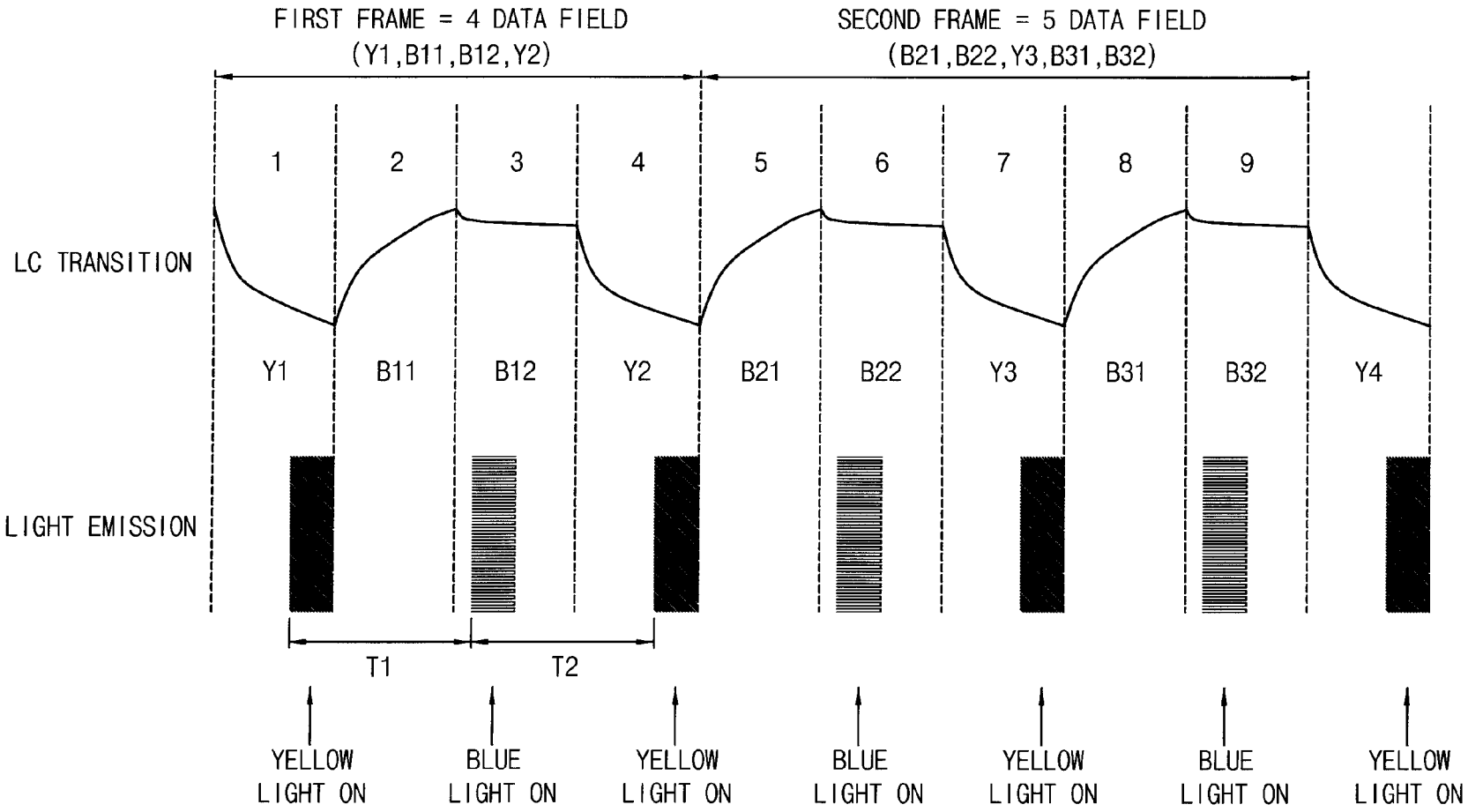
FIGS. 7 and 8 illustrate emitting timing diagrams based on a liquid crystal response in a first frame and a second frame.
Figure 8:
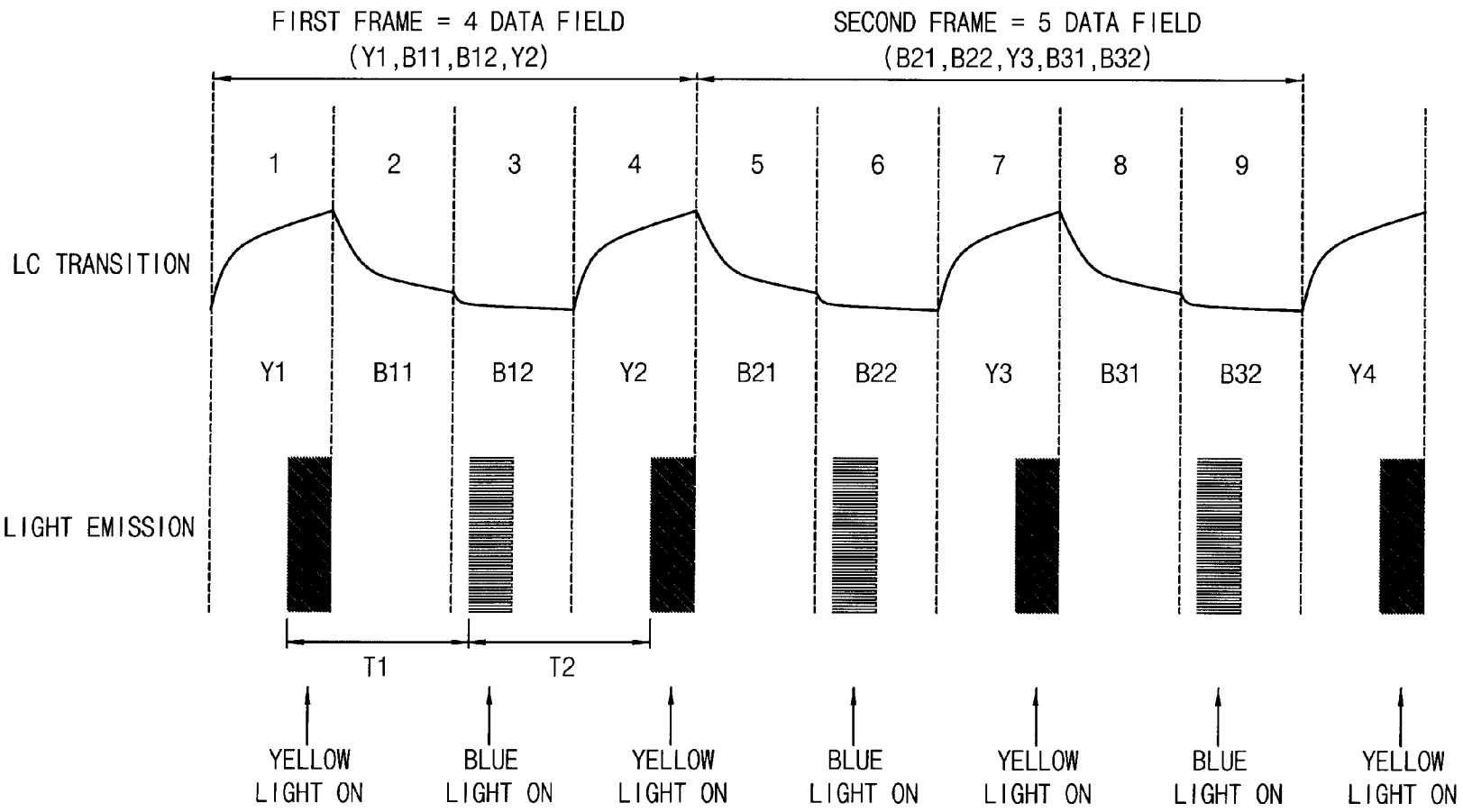

FIGS. 7 and 8 illustrate emitting timing diagrams based on a liquid crystal response in a first frame and a second frame.

The display apparatus according to the exemplary embodiment illustrated in FIGS. 7 and 8 is substantially the same as the display apparatus in FIGS. 1 to 4B except for the driving timing of the panel driver and the light source driver. Thus, the same reference numerals will be used to refer to same or like parts as those described with reference to FIGS. 1 to 4B and any further repetitive explanation concerning the above elements will be omitted.

Referring to FIGS. 1 to 3B, 7, and 8, a frame (e.g., a unit frame corresponding to a single input image data) is divided into a plurality of frames. A first frame includes a first sub frame, a second sub frame, a third sub frame, and a fourth sub frame. A second frame includes a fifth sub frame, a sixth sub frame, a seventh sub frame, an eighth sub frame, and a ninth sub frame.

The grayscale data includes a first grayscale data Y1, a second grayscale data B11, a third grayscale data B12, a fourth grayscale data Y2, a fifth grayscale data B21, a sixth grayscale data B22, a seventh grayscale data Y3, an eighth grayscale data B31, and a ninth grayscale data B32. The first, fourth, and seventh grayscale data Y1, Y2, and Y3 are associated with the first light source 210. The second, third, fifth, sixth, eighth and ninth grayscale data B11, B12, B21, B22, B31, and B21 are associated with the second light source 220.

The panel driver 300 outputs the first grayscale data Y1 to the display panel 100 during the first sub frame. The panel driver 300 outputs the second grayscale data B11 to the display panel 100 during the second sub frame. The panel driver 300 outputs the third grayscale data B12 to the display panel 100 during the third sub frame. The panel driver 300 outputs the fourth grayscale data Y2 to the display panel 100 during the fourth sub frame. The panel driver 300 outputs the fifth grayscale data B21 to the display panel 100 during the fifth sub frame. The panel driver 300 outputs the sixth grayscale data B22 to the display panel 100 during the sixth sub frame. The panel driver 300 outputs the seventh grayscale data Y3 to the display panel 100 during the seventh sub frame. The panel driver 300 outputs the eighth grayscale data B31 to the display panel 100 during the eighth sub frame. The panel driver 300 outputs the ninth grayscale data B32 to the display panel 100 during the ninth sub frame.

A liquid crystal molecule of the liquid crystal layer 130 is re-aligned to display a grayscale of the first grayscale data Y1 during the first sub frame. The light source driver 400 turns on the first light source 210 during the first sub frame. For example, the light source driver 400 may turn on the first light source 210 in an end portion of the first sub frame.

The liquid crystal molecule of the liquid crystal layer 130 is re-aligned to display a grayscale of the second grayscale data B11 during the second sub frame.

The liquid crystal molecule of the liquid crystal layer 130 is re-aligned to display a grayscale of the third grayscale data B12 during the third sub frame. The light source driver 400 turns on the second light source 220 during the third sub frame. For example, the light source driver 400 may turn on the second light source 220 in a middle portion of the third sub frame.

A liquid crystal molecule of the liquid crystal layer 130 is re-aligned to display a grayscale of the fourth grayscale data Y2 during the fourth sub frame. The light source driver 400 turns on the first light source 210 during the fourth sub frame. For example, the light source driver 400 may turn on the first light source 210 in an end portion of the fourth sub frame.

The liquid crystal molecule of the liquid crystal layer 130 is re-aligned to display a grayscale of the fifth grayscale data B21 during the fifth sub frame.

The liquid crystal molecule of the liquid crystal layer 130 is re-aligned to display a grayscale of the sixth grayscale data B22 during the sixth sub frame. The light source driver 400 turns on the second light source 220 during the sixth sub frame. For example, the light source driver 400 may turn on the second light source 220 in a middle portion of the sixth sub frame.

A liquid crystal molecule of the liquid crystal layer 130 is re-aligned to display a grayscale of the seventh grayscale data Y3 during the seventh sub frame. The light source driver 400 turns on the first light source 210 during the seventh sub frame. For example, the light source driver 400 may turn on the first light source 210 in an end portion of the seventh sub frame.

The liquid crystal molecule of the liquid crystal layer 130 is re-aligned to display a grayscale of the eighth grayscale data B31 during the eighth sub frame.

The liquid crystal molecule of the liquid crystal layer 130 is re-aligned to display a grayscale of the ninth grayscale data B32 during the ninth sub frame. The light source driver 400 turns on the second light source 220 during the ninth sub frame. For example, the light source driver 400 may turn on the second light source 220 in a middle portion of the ninth sub frame.

A first interval T1 corresponds to a period starting from turning on the first light source 210 to subsequently turning on the second light source 220. A second interval T2 corresponds to a period starting from turning on the second light source 220 to subsequently turning on the first light source 210. The first interval T1 may be substantially the same as the second interval T2.

Referring to FIG. 7, the second grayscale data B11 may include an over-drive value to increase a response speed of the liquid crystal layer 130 during the third sub frame.

The third grayscale data B12 may be applied to pre-tilting liquid crystal molecules to increase the response speed of the liquid crystal layer 130 during the third sub frame.

The fifth grayscale data B21 may include an over-drive value to increase a response speed of the liquid crystal layer 130 during the sixth sub frame.

The sixth grayscale data B22 may be applied to pre-tilting liquid crystal molecules to increase the response speed of the liquid crystal layer 130 during the sixth sub frame.

The eighth grayscale data B31 may include an over-drive value to increase a response speed of the liquid crystal layer 130 during the ninth sub frame.

The ninth grayscale data B32 may be applied to pre-tilting liquid crystal molecules to increase the response speed of the liquid crystal layer 130 during the ninth sub frame.

The first to third sub frames, the fourth to sixth sub frames, and the seventh to ninth sub frames may be driven in a substantially same manner as the first to third sub frames of FIG. 6.

Referring to FIG. 8, the second grayscale data B11 may be substantially the same as the third grayscale data B12. The fifth grayscale data B21 may be substantially the same as the sixth grayscale data B22. The eighth grayscale data B31 may be substantially the same as the ninth grayscale data B32.

In some alternative embodiments, the second grayscale data B11 may be different from the third grayscale data B12. The fifth grayscale data B21 may be different from the sixth grayscale data B22. The eighth grayscale data B31 may be different from the ninth grayscale data B32.

The liquid crystal molecule of the liquid crystal layer 130 is re-aligned to display a relatively high grayscale during the first sub frame, the fourth sub frame, and the seventh sub frame. Thus, most of the light emitted from the first light source 210 may pass through the liquid crystal layer 130.

The liquid crystal molecule of the liquid crystal layer 130 is re-aligned to display a relatively low grayscale during the second sub frame, the fifth sub frame, and the eighth sub frame. The first and second light sources 210 and 220 may not emit the light in the second sub frame, the fifth sub frame, and the eighth sub frame.

During the third sub frame, the liquid crystal molecule of the liquid crystal layer 130 is re-aligned by the third grayscale data B12 to display a grayscale which is less than the grayscale of the second sub frame. Thus, most of the light emitted from the second light source 220 may not pass through the liquid crystal layer 130.

During the sixth sub frame, the liquid crystal molecule of the liquid crystal layer 130 is re-aligned by the sixth grayscale data B22 to display a grayscale which is less than the grayscale of the fifth sub frame. Thus, most of the light emitted from the second light source 220 may not pass through the liquid crystal layer 130.

During the ninth sub frame, the liquid crystal molecule of the liquid crystal layer 130 is re-aligned by the ninth grayscale data B32 to display a grayscale which is less than the grayscale of the eighth sub frame. Thus, most of the light emitted from the second light source 220 may not pass through the liquid crystal layer 130.

In the present exemplary embodiment, during the first frame, the first grayscale data Y1, the second grayscale data B11, the third grayscale data B12, and the fourth grayscale data Y2 are applied to the display panel 100 in the above listed order. During the second frame, the fifth grayscale data B21, the sixth grayscale data B22, the seventh grayscale data Y3, the eighth grayscale data B31, and the ninth grayscale data B32 are applied to the display panel 100 in the above listed order. Thus, the grayscale data progress asymmetrically. During the first frame to the second frame, the first light source 210, the second light source 220, the first light source 210, the second light source 220, the first light source 210, and the second light source 220 are turned on in the above listed order. Thus, the light sources are driven symmetrically.

Referring to FIG. 7, grayscale data including the over-drive values are output to the display panel 100 during the second sub frame, the fifth sub frame, and the eighth sub frame. Grayscale data, which are applied to pre-tilting liquid crystal molecules, are output to the display panel 100 during the third sub frame, the sixth sub frame, and the ninth sub frame. Thus, the response speed of the liquid crystal layer 130 may increase. Accordingly, the brightness of the display may increase and the color breakup defect may decrease.

Referring to FIG. 8, during the second sub frame and the third sub frame in which a same light source is turned on, the grayscale data may include a black image. During the fifth sub frame and the sixth sub frame in which a same light source is turned on, the grayscale data may include the black image. During the eighth sub frame and the ninth sub frame in which a same light source is turned on, the grayscale data may include the black image. Thus, color reproducibility may be improved.

According to one or more of the illustrated exemplary embodiments, in a field sequential driving method, a field dividing rate may be given by 1:2, by repeatedly outputting a grayscale data associated with a determined light source. Thus, the response speed of the liquid crystal layer may increase, the brightness of the display may increase, the color breakup defect may decrease, and the color reproducibility may be improved. Accordingly, the display quality may be improved.

A display apparatus of the illustrated exemplary embodiments may be applied to a mobile type display apparatus such as a mobile phone, a note book computer or a tablet computer, a fixed type display (such as a television or a desktop display), or a display of a general appliance (such as a refrigerator, a washing machine, or an air conditioner).

The above-described embodiments are merely illustrative of the inventive concept and should not be construed as limiting the inventive concept. Although a few exemplary embodiments of the inventive concept have been described, those skilled in the art will readily appreciate that many modifications may be made to the embodiments without departing from the teachings and advantages of the inventive concept. Accordingly, all such modifications are intended to be included within the scope of the inventive concept as defined in the claims.

What is claimed is:

1. A display apparatus comprising:

a display panel comprising:

a first sub pixel having a first primary color;

a second sub pixel having a second primary color; and a transparent sub pixel;

a light source part configured to provide light to the display panel, wherein the light source part comprises a first light source and a second light source having colors different from each other;

a panel driver configured to output a first grayscale data to the display panel during a first sub frame, a second grayscale data to the display panel during a second sub frame, and a third grayscale data to the display panel during a third sub frame, wherein the first grayscale data is associated with the first light source, and the second grayscale data and the third grayscale data are associated with the second light source, wherein the first sub frame, the second sub frame, and the third sub frame are included in a first frame; and a light source driver configured to alternately turn on the first light source and the second light source, wherein the second sub frame is contiguous to the first sub frame, and the third sub frame is contiguous to the second sub frame.

2. The display apparatus of claim 1, wherein the light source driver is configured to turn on the first light source during the first sub frame, and to turn on the second light source during the third sub frame.

3. The display apparatus of claim 2, wherein the second grayscale data is the same as the third grayscale data, and the light source driver is configured to turn on the first light source in an end portion of the first sub frame, and to turn on the second light source in an end portion of the third sub frame.

4. The display apparatus of claim 2, wherein the second grayscale data is different from the third grayscale data, and wherein a first interval is the same as a second interval, the first interval corresponding to a period starting from turning on the first light source to subsequently turning on the second light source, and the second interval corresponding to a period starting from turning on the second light source to subsequently turning on the first light source.

5. The display apparatus of claim 1, wherein the light source driver is configured to turn on the first light source in an end portion of the first sub frame, and to turn on the second light source in a middle portion of the third sub frame.

6. The display apparatus of claim 1, wherein the third grayscale data is greater than the first grayscale data, and the second grayscale data is greater than the third grayscale data.

7. The display apparatus of claim 1, wherein the third grayscale data is less than the first grayscale data, and the second grayscale data is less than the third grayscale data.

8. The display apparatus of claim 1, wherein the first frame further comprises a fourth sub frame, a second frame comprises a fifth sub frame, a sixth sub frame, a seventh sub frame, an eighth sub frame, and a ninth sub frame, the panel driver is configured to output a fourth grayscale data to the display panel during the fourth sub frame, a fifth grayscale data to the display panel during the fifth sub frame, a sixth grayscale data to the display panel during the fifth sub frame, a seventh grayscale data to the display panel during the seventh sub frame, an eighth grayscale data to the display panel during the eighth sub frame, and a ninth grayscale data to the display panel during the ninth sub frame, the fourth grayscale data and the seventh grayscale data associated with the first light source, and the fifth grayscale data, the sixth grayscale data, the eighth grayscale data, and the ninth grayscale data associated with the second light source.

9. The display apparatus of claim 8, wherein when the third grayscale data is greater than the first grayscale data, the second grayscale data is greater than the third grayscale data, when the sixth grayscale data is greater than the fourth grayscale data, the fifth grayscale data is greater than the sixth grayscale data, and when the ninth grayscale data is greater than the seventh grayscale data, the eighth grayscale data is greater than the ninth grayscale data.

10. The display apparatus of claim 8, wherein the second grayscale data, the third grayscale data, the fifth grayscale data, the sixth grayscale data, the eighth grayscale data, and the ninth grayscale data comprise grayscale values corresponding to a black image.

11. The display apparatus of claim 8, wherein the light source driver is configured to turn on the first light source during the first sub frame, the fourth sub frame, and the seventh sub frame, and to turn on the second light source during the third sub frame, the sixth sub frame, and the ninth sub frame.

12. The display apparatus of claim 11, wherein a first interval is the same as a second interval, the first interval corresponding to a period starting from turning on the first light source to subsequently turning on the second light source, and the second interval corresponding to a period starting from turning on the second light source to subsequently turning on the first light source.

13. The display apparatus of claim 12, wherein the light source driver is configured to turn on the first light source in end portions of the first sub frame, the fourth sub frame, and the seventh sub frame, and to turn on the second light source in middle portions of the third sub frame, the sixth sub frame, and the ninth sub frame.

14. The display apparatus of claim 1, wherein the first light source is configured to generate light having one of the third primary color and a mixed color of the first primary color and the second primary color, and the second light source is configured to generate light having the other one of the third primary color and the mixed color of the first primary color and the second primary color.

15. The display apparatus of claim 14, wherein the mixed color is yellow, and the third primary color is blue.

16. A method of driving a display apparatus, the method comprising:

outputting a first grayscale data to a display panel during a first sub frame, the first grayscale data associated with a first light source, wherein the display panel comprises a first sub pixel having a first primary color, a second sub pixel having a second primary color, and a transparent sub pixel;

turning on the first light source during the first sub frame;

outputting a second grayscale data to the display panel during a second sub frame, the second grayscale data associated with a second light source having a different color from the first light source;

outputting a third grayscale data to the display panel during a third sub frame, the third grayscale data associated with the second light source; and turning on the second light source during the third sub frame, wherein the first sub frame, the second sub frame, and the third sub frame are included in a first frame;

wherein the second sub frame is contiguous to the first sub frame, and the third sub frame is contiguous to the second sub frame.

17. The method of claim 16, wherein:

the first light source is configured to be turned on in an end portion of the first sub frame, the second light source is configured to be turned on in an end portion of the third sub frame, and the second grayscale data is the same as the third grayscale data.

18. The method of claim 16, wherein:

a first interval is the same as a second interval, the first interval corresponding to a period starting from turning on the first light source to subsequently turning on the second light source, and the second interval corresponding to a period starting from turning on the second light source to subsequently turning on the first light source, if the third grayscale data is greater than the first grayscale data, the second grayscale data is greater than the third grayscale data, and if the third grayscale data is less than the first grayscale data, the second grayscale data is less than the third grayscale data.

19. The method of claim 16, further comprising:

outputting a fourth grayscale data to the display panel during a fourth sub frame, the fourth grayscale data associated with the first light source;

turning on the first light source during the fourth sub frame;

outputting a fifth grayscale data to the display panel during a fifth sub frame, the fifth grayscale data associated with the second light source;

outputting a sixth grayscale data to the display panel during a sixth sub frame, the sixth grayscale data associated with the second light source;

turning on the second light source during the sixth sub frame;

outputting a seventh grayscale data to the display panel during a seventh sub frame, the seventh grayscale data associated with the first light source;

turning on the first light source during the seventh sub frame;

outputting a eighth grayscale data to the display panel during a eighth sub frame, the eighth grayscale data associated with the second light source;

outputting a ninth grayscale data to the display panel during a ninth sub frame, the ninth grayscale data associated with the second light source; and turning on the second light source during the ninth sub frame, wherein the first frame further comprises the fourth sub frame, and a second frame comprises the fifth sub frame, the sixth sub frame, the seventh sub frame, the eighth sub frame, and the ninth sub frame.

20. The method of claim 19, wherein a first interval is the same as a second interval, the first interval corresponding to a period starting from turning on the first light source to subsequently turning on the second light source, and the second interval corresponding to a period starting from turning on the second light source to subsequently turning on the first light source.

* * * * *